US007926985B2

(12) United States Patent
Teng et al.

(10) Patent No.: US 7,926,985 B2
(45) Date of Patent: Apr. 19, 2011

(54) CUSTOM ASSEMBLY LIGHT-EMITTING MODULE

(75) Inventors: Chien-Chen Teng, Keelung (TW); Fang-Po Wang, Taipei County (TW); Wen-Chieh Chang Chien, Taipei County (TW)

(73) Assignee: Ledtech Electronics Corp., Taipei County (TW)

( * ) Notice: Subject to any disclaimer, the term of this patent is extended or adjusted under 35 U.S.C. 154(b) by 0 days.

(21) Appl. No.: 12/697,567

(22) Filed: Feb. 1, 2010

(65) Prior Publication Data

US 2010/0128485 A1 May 27, 2010

Related U.S. Application Data

(63) Continuation-in-part of application No. 12/219,459, filed on Jul. 23, 2008, now abandoned.

(51) Int. Cl.
*F21S 8/04* (2006.01)

(52) U.S. Cl. ..... 362/373; 362/294; 362/311.01; 362/217.12; 362/218

(58) Field of Classification Search ..... 362/147, 362/152, 153, 153.1, 217.01, 217.02, 218–225, 362/231, 235, 240, 241, 246, 249.01, 249.02, 362/249.04, 249.06, 249.12, 294, 327, 329, 355, 361–363, 373, 490, 545, 547, 800
See application file for complete search history.

(56) References Cited

U.S. PATENT DOCUMENTS

| | | | | |
|---|---|---|---|---|
| 5,607,227 | A * | 3/1997 | Yasumoto et al. | 362/249.06 |
| 6,361,186 | B1 * | 3/2002 | Slayden | 362/241 |
| 6,592,238 | B2 * | 7/2003 | Cleaver et al. | 362/246 |
| 7,244,058 | B2 * | 7/2007 | DiPenti et al. | 362/547 |
| 7,267,461 | B2 * | 9/2007 | Kan et al. | 362/373 |
| 7,654,703 | B2 * | 2/2010 | Kan et al. | 362/362 |

* cited by examiner

*Primary Examiner* — Hargobind S Sawhney
(74) *Attorney, Agent, or Firm* — Rosenberg, Klein & Lee

(57) ABSTRACT

A custom assembly light-emitting module includes a base unit, a light-emitting unit and a lens unit. The base unit has a heat-dissipating base and two first retaining structures extending upwards from two opposite lateral sides of the heat-dissipating base. The light-emitting unit is detachably disposed on the heat-dissipating base. The lens unit has a lens and two second retaining structures formed on two opposite lateral sides of the lens, wherein the lens unit is detachably disposed over the light-emitting unit by matching the two first retaining structures and the two second retaining structures. Hence, the base unit, the light-emitting unit and the lens unit can be replaced according to the user's different requirements.

14 Claims, 8 Drawing Sheets

CUSTOM ASSEMBLY LIGHT-EMITTING MODULE

CROSS REFERENCE TO RELATED APPLICATION

This application is a continuation-in-part of U.S. application Ser. No. 12/219,459, filed on 23 Jul. 2008 and entitled "custom assembly light-emitting module", now pending.

BACKGROUND OF THE INVENTION

1. Field of the Invention

The present invention relates to a light-emitting module, and particularly relates to a custom assembly light-emitting module having a heat-dissipating base, a light-emitting element and a lens all of which are replaceable according to user requirements.

2. Description of the Related Art

A traditional light-emitting device is used to provide illumination for humans, such as simple illumination or illumination for enhancing the aspect of the environment. However, the standard of the traditional light-emitting device is fixed such as fixed heat-dissipating effect, fixed light-emitting effect, and fixed light-projecting angle.

When the user purchases the traditional light-emitting device, the components of the traditional light-emitting device cannot be replaced. In other words, because the standard of the traditional light-emitting device is fixed, the components of the traditional light-emitting device cannot be replaced according to the user's different requirements.

SUMMARY OF THE INVENTION

One particular aspect of the present invention is to provide a custom assembly light-emitting module that includes a base unit, a light-emitting unit and a lens unit that are replaceable according to the user's different requirements. Hence, the base unit is replaceable according to different heat-dissipating effects, the light-emitting unit is replaceable according to different light-emitting effects, and the lens unit is replaceable according to different light-projecting angles.

In order to achieve the above-mentioned aspects, the present invention provides a custom assembly light-emitting module, including: a base unit, a light-emitting unit and a lens unit. The base unit has a heat-dissipating base and two first retaining structures formed on two opposite lateral sides of the heat-dissipating base. The light-emitting unit is detachably disposed on the heat-dissipating base. The lens unit has a lens and two second retaining structures extending downwards from two opposite lateral sides of the lens, wherein the lens unit is detachably disposed over the light-emitting unit by matching the two first retaining structures and the two second retaining structures.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1A:
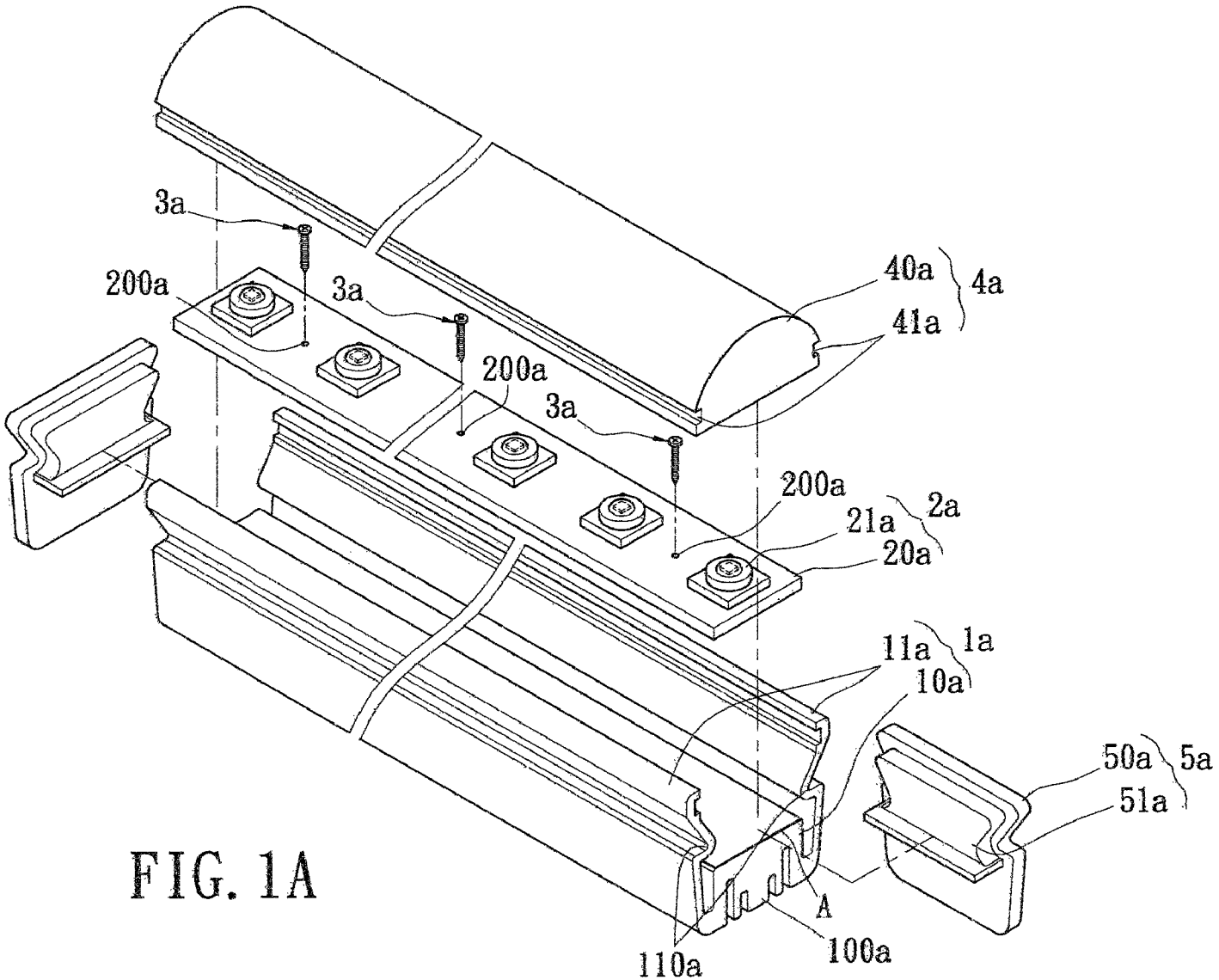
FIG. 1A is a perspective, exploded view of a custom assembly light-emitting module according to the first embodiment of the present invention.
Figure 1B:
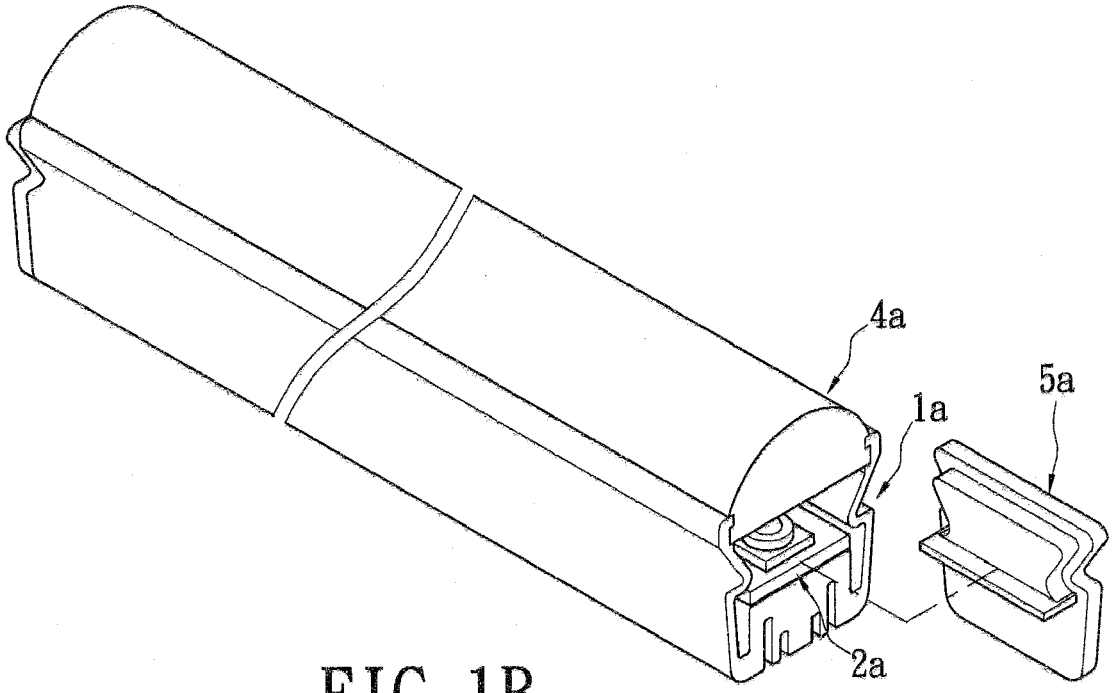
FIG. 1B is a perspective, assembled view of a custom assembly light-emitting module when a cover unit opening according to the first embodiment of the present invention.

Referring to FIGS. 1A to 1D, the first embodiment of the present invention provides a custom assembly light-emitting module, including: a base unit 1*a*, a light-emitting unit 2*a*, a plurality of screw elements 3*a*, a lens unit 4*a*, and two cover unit 5*a*.

The base unit 1*a* has a heat-dissipating base 10*a* and two first retaining structures 11*a* extending upwards from two opposite lateral sides of the heat-dissipating base 10*a*. Each first retaining structure 11*a* has a concave retaining portion 110*a* formed on its outside. In addition, the heat-dissipating base 10*a* has a plurality of heat-dissipating fins 100*a* disposed on its bottom portion. However, the type of the heat-dissipating fins 100*a* is just an example. The shape, the arrangement, the size and the number of the heat-dissipating fins 100*a* are changeable according to different design requirements. Hence, the present invention can choose different heat-dissipating bases according to different heat-dissipating requirements the user's requirement.

The light-emitting unit 2*a* has a substrate 20*a* and a plurality of light-emitting elements 21*a* electrically disposed on the substrate 20*a*. The substrate 20*a* has a plurality of through holes 200*a* corresponding to the screw elements 3*a*, and one part of each screw element 3*a* passes through the corresponding through hole 200*a* so as to fix the substrate 20*a* on the heat-dissipating base 10*a*. In addition, the first embodiment further includes a fine layer of heat-conducting glue A disposed between the heat-dissipating base 10*a* and the substrate 20*a* by coating or printing; Alternatively, the first embodiment further includes a heat-conducting piece (not shown) glued between the heat-dissipating base 10*a* and the substrate 20*a*, so as to increase the heat-dissipating efficiency of transmitting heat from the light-emitting unit 2*a* to the heat-dissipating base 10*a*. However, using the screw elements 3*a* to fix the substrate 20*a* on the heat-dissipating base 10*a* is just an example. Any method for fixing the substrate 20*a* on the heat-dissipating base 10*a* is protected in the present invention. In other words, the light-emitting unit 2*a* can be detachably disposed on the heat-dissipating base 10*a* by any assembly method. Hence, the space, the color, the number and the power of the light-emitting elements 21*a* can be changed according to user's requirement.

The lens unit 4*a* has a lens 40*a* and two second retaining structures 41*a* formed on two opposite lateral sides of the lens 40*a*. The two retaining structures 41*a* correspond to the two first retaining structures 11*a* respectively. Hence, the lens unit 4*a* is detachably disposed over the light-emitting unit 2*a* by matching the two first retaining structures 11*a* and the two second retaining structures 41*a*. In the first embodiment, the two first retaining structures 11*a* are two first sliding grooves facing each other, the two second retaining structures 41*a* are two second sliding grooves in opposite direction to each other, the two first sliding grooves and the two second sliding grooves are slidably matched with each other. However, the match between the two first sliding grooves and the two second sliding grooves is just an example. The lens unit 4*a* can be detachably disposed over the light-emitting unit 2*a* by any matching method.

The two cover units 5*a* are respectively covering two opposite lateral sides of the base unit 1*a*. Each cover unit 5*a* has a cover body 50*a* and a protruding portion 51*a* projecting from the cover body 50*a* and fitted tightly between the two first retaining structures 11*a*.

Figure 1C:
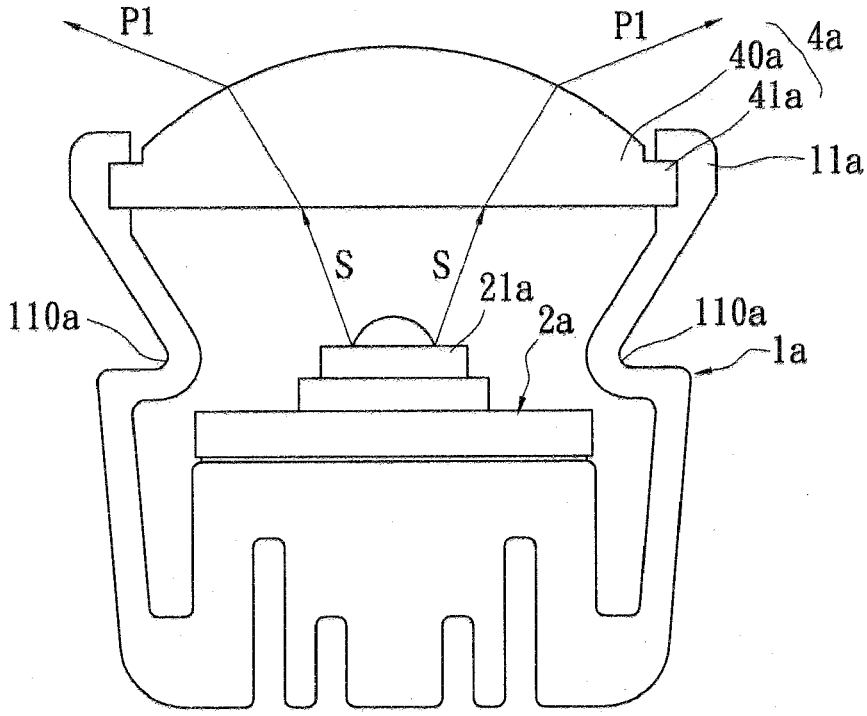
FIG. 1C is a lateral, schematic view of a custom assembly light-emitting module without the cover unit according to the first embodiment of the present invention.

Referring to FIG. 1C, the light beams S generated by the light-emitting elements 21*a* pass through the lens 40*a* and generate projecting light beams P1 with predetermined light-projecting angles. Hence, the lens 40*a* can be changed according to the different light-projecting angles the user's requirement.

Figure 1D:
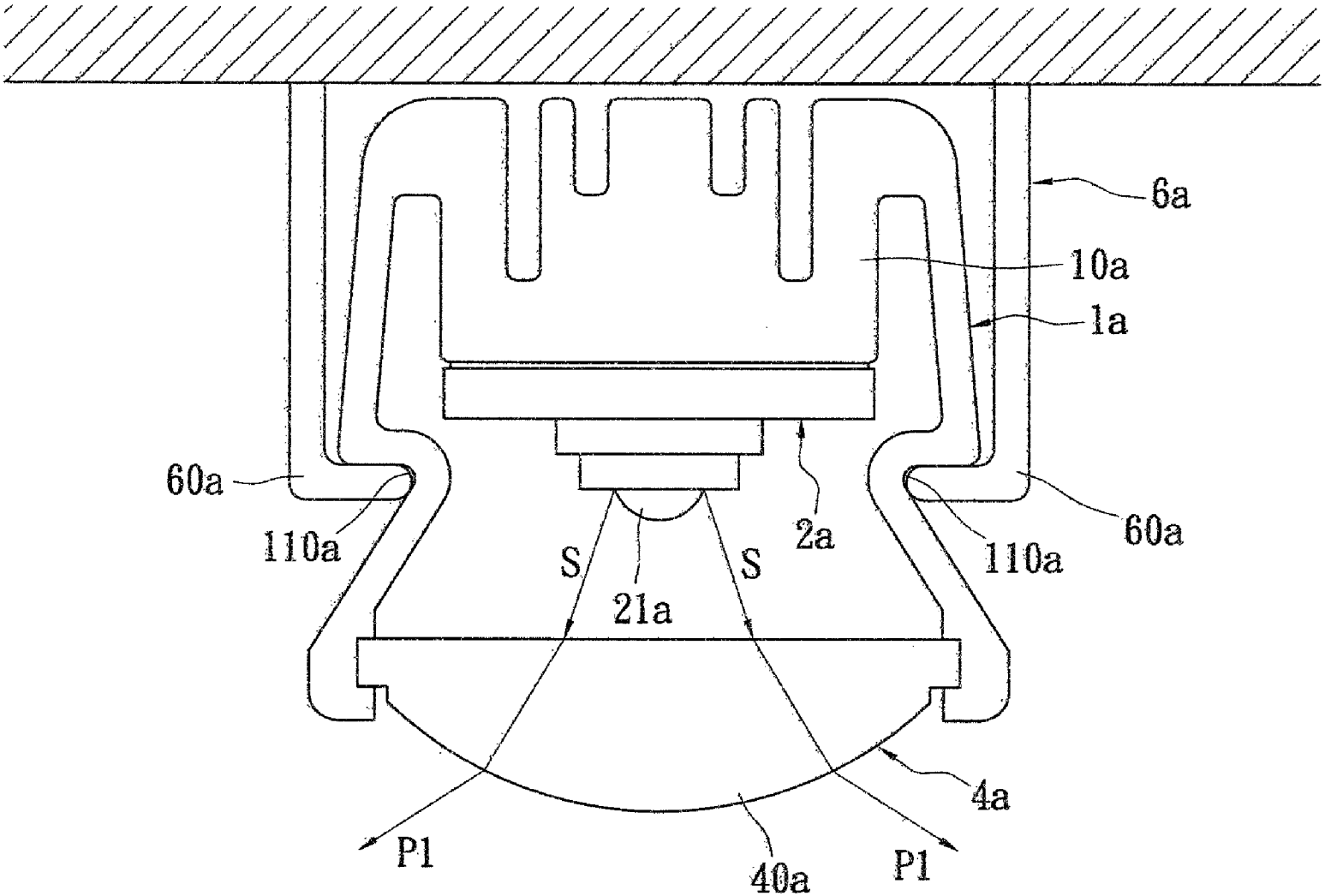
FIG. 1D is a lateral, schematic view of a custom assembly light-emitting module fixed by a hooking unit according to the first embodiment of the present invention.

Referring to FIG. 1D, the base unit 1*a* is inverted and retained in a hooking unit 6*a* by the two concave retaining portions 110*a* mating with the hooking unit 6*a*. For example, when a user wants to place the custom assembly light-emitting module of the present invention on a ceiling (or on a wall or on any object), the base unit 1*a* can be inverted and retained between two hooking structures 60*a* of the hooking unit 6*a* by matching the two concave retaining portions 110*a* and the hooking structures 60*a* on the ceiling. The heat-dissipating base 10*a* is hidden in the hooking unit 6*a*, and the lens 40*a* is exposed out of the hooking unit 6*a*. Hence, the light beams S generated by the light-emitting elements 21*a* pass through the lens 40*a* and generate upwards projecting light beams P1 with predetermined light-projecting angles so as to provide brightness the user's requirement. In addition, the present invention can generate different light-projecting angles due to the replacement of the lens 40*a*.

Figure 1E:
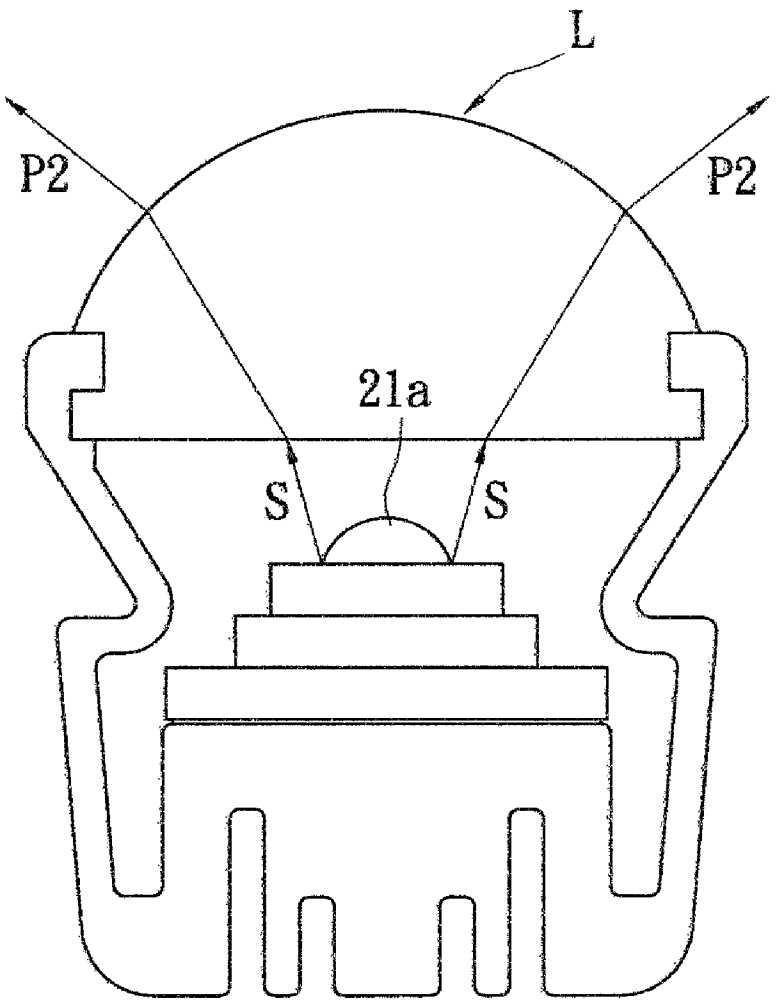
FIG. 1E is a lateral, schematic view of a custom assembly light-emitting module using another type of lens unit according to the first embodiment of the present invention.

Referring to FIG. 1E, the difference between FIG. 1E and FIG. 1C is that: the lens 40*a* has been replaced by another lens L in FIG. 1E. Hence, the light beams S generated by the light-emitting elements 21*a* pass through the lens L and generate projecting light beams P2 with another predetermined light-projecting angle.

Referring to FIGS. 2A to 2D, the second embodiment of the present invention provides a custom assembly light-emitting module, including: a base unit 1*b*, a light-emitting unit 2*b*, a plurality of screw elements 3*b*, a lens unit 4*b*, and two cover unit 5*b*.

The base unit 1*b* has a heat-dissipating base 10*b* and two first retaining structures 11*b* formed on two opposite lateral sides of the heat-dissipating base 10*b*. In addition, the heat-dissipating base 10*b* has a plurality of heat-dissipating fins or a heat-dissipating body 100*b* disposed on its bottom portion. However, the type of the heat-dissipating body 100*b* is just an example. The shape, the arrangement, the size and the number of the heat-dissipating fins are changeable according to different design requirements. Hence, the present invention can choose different heat-dissipating bases according to different heat-dissipating requirements the user wants.

The light-emitting unit 2*b* has a substrate 20*b* and a plurality of light-emitting elements 21*b* electrically disposed on the substrate 20*b*. The substrate 20*b* has a plurality of through holes 200*b* corresponding to the screw elements 3*b*, and one part of each screw element 3*b* passes through the corresponding through hole 200*b* so as to fix the substrate 20*b* on the heat-dissipating base 10*b*. In addition, the second embodiment further includes a fine layer of heat-conducting glue A disposed between the heat-dissipating base 10*b* and the substrate 20*b* by coating or printing; Alternatively, the second embodiment further includes a heat-conducting piece (not shown) glued between the heat-dissipating base 10*b* and the substrate 20*b*, so as to increase the heat-dissipating efficiency of transmitting heat from the light-emitting unit 2*b* to the heat-dissipating base 10*b*. However, using the screw elements 3*b* to fix the substrate 20*b* on the heat-dissipating base 10*b* is just an example. Any method for fixing the substrate 20*b* on the heat-dissipating base 10*b* is protected in the present invention. In other words, the light-emitting unit 2*b* can be detachably disposed on the heat-dissipating base 10*b* by any assembly method. Hence, the space, the color, the number and the power of the light-emitting elements 21*b* can be changed according to user's requirement.

The lens unit 4*b* has a lens 40*b*, two reflected portions 42*b* extending downwards from two opposite lateral sides of the lens 40*b* and two second retaining structures 41*b* respectively extending downwards from the two reflected portions 42*b*. The two second retaining structures 41*b* correspond to the two first retaining structures 11*b* respectively.

Each reflected portion 42*b* has an inclined surface 420*b* formed on an inner wall thereof and a reflective layer 421*b* formed on each inclined surface 420*b*, and the two inclined surfaces 420*b* of the two reflected portions 42*b* face each other and are disposed beside two opposite lateral sides of the light-emitting unit 2*b*. In addition, the two reflected portions 42*b* and the two second retaining structures 41*b* are light-transmitting substances.

Furthermore, each reflected portion 42*b* is extended obliquely from the lens 40*b*, and each second retaining structure 41*b* has a top bending portion 410*b* bent downwards from each reflected portion 42*b*, an extending portion 411*b* extended obliquely from the top bending portion 410*b*, and a bottom bending portion 412*b* bent downwards from the extending portion 411*b*. In addition, each top bending portion 410*b* has an S shape, and each bottom bending portion 412*b* has an L shape.

Hence, the lens unit 4*b* is detachably mated with the base unit 1*b* by slidably engaging the two first retaining structures 11*b* respectively with the two second retaining structures 41*b*. In the second embodiment, the two first retaining structures 11*b* are two first sliding grooves facing each other, the two second retaining structures 41*b* are two second sliding grooves in opposite direction to each other, the two first sliding grooves and the two second sliding grooves are slidably matched with each other. However, the match between the two first sliding grooves and the two second sliding grooves is just an example. The lens unit 4*b* can be detachably disposed over the light-emitting unit 2*b* by any matching method.

The two cover units 5*b* are respectively covering two opposite lateral sides of the base unit 1*b*. Each cover unit 5*b* has a cover body 50*b* and a protruding portion 51*b* projecting from the cover body 50*b* and fitted tightly between the two second retaining structures 41*b*.

Referring to FIG. 20, the light beams S generated by the light-emitting elements 21*b* pass through the lens 40*b* and generate projecting light beams P3 with predetermined light-projecting angles. In addition, one part of light beams S generated by the light-emitting elements 21*b* are reflected by the two reflective layers 421*b*. Hence, the lens 40*b* is changeable according to the different light-projecting angles that the user wants.

Figure 2A:
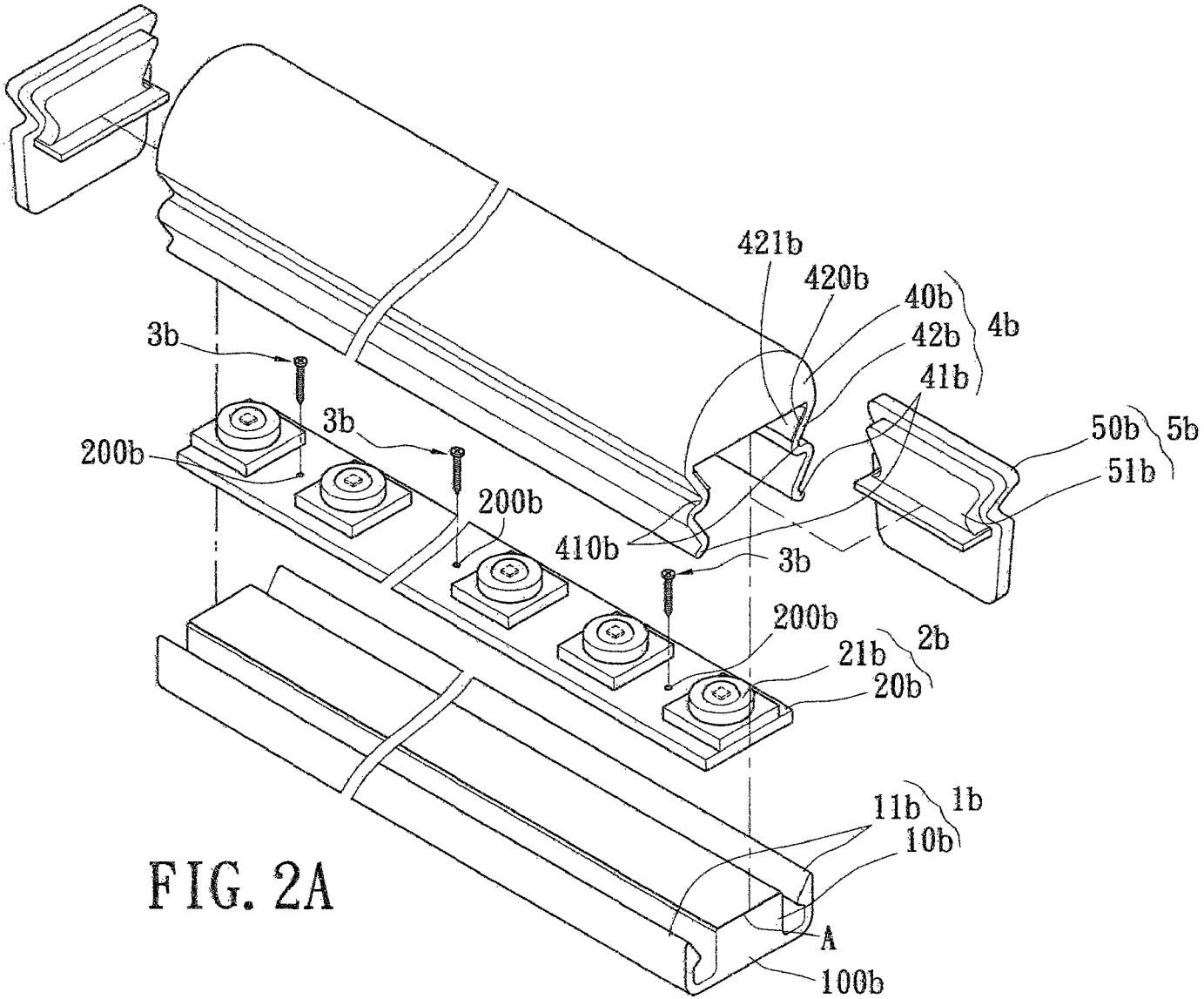
FIG. 2A is a perspective, exploded view of a custom assembly light-emitting module according to the second embodiment of the present invention.
Figure 2B:
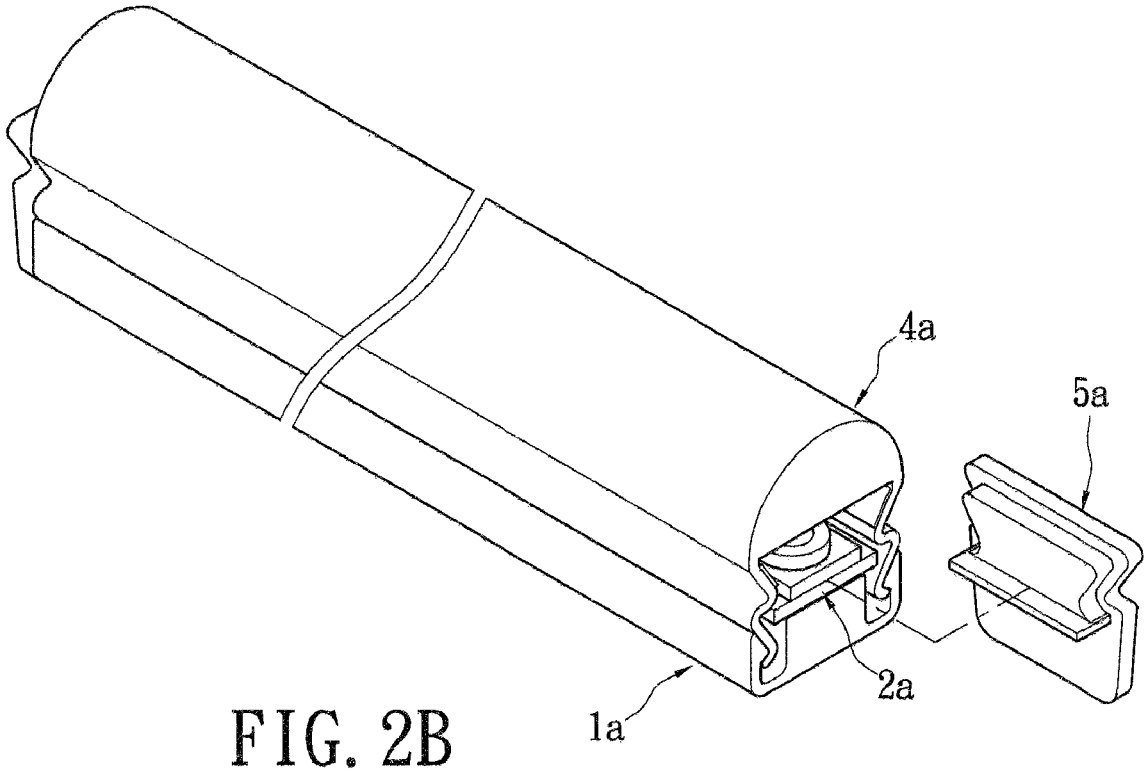
FIG. 2B is a perspective, assembled view of a custom assembly light-emitting module when a cover unit opening according to the second embodiment of the present invention.
Figure 2C:
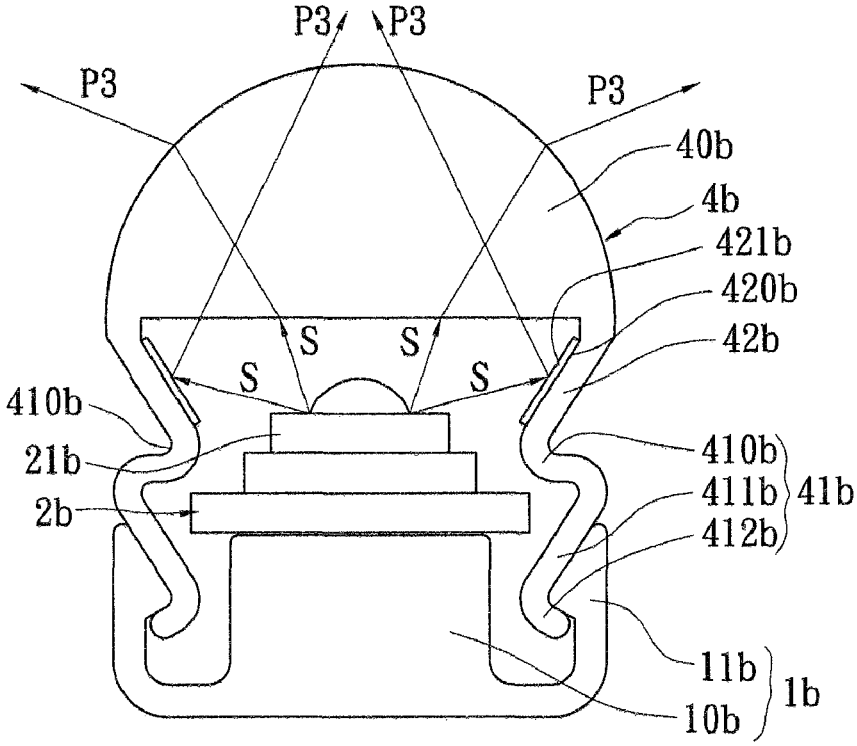
FIG. 2C is a lateral, schematic view of a custom assembly light-emitting module without the cover unit according to the second embodiment of the present invention.
Figure 2D:
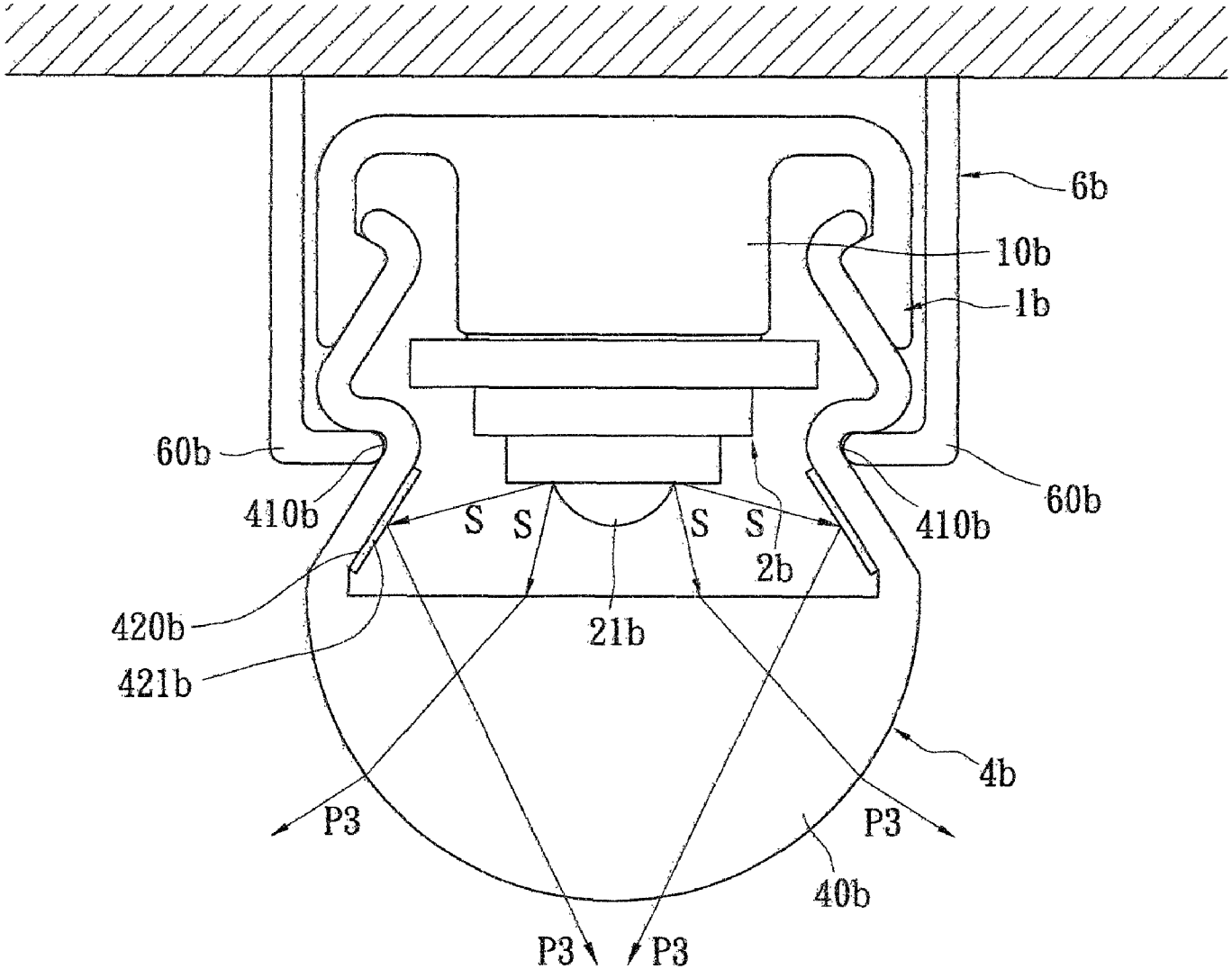
FIG. 2D is a lateral, schematic view of a custom assembly light-emitting module fixed by a hooking unit according to the second embodiment of the present invention.

Referring to FIG. 2D, the lens unit 4*b* is inverted and retained under a hooking unit 6*b* by the two top bending portions 410*b* matching with the hooking unit 6*b*. For example, when a user wants to place the custom assembly light-emitting module of the present invention on a ceiling (or on a wall or on any object), the base unit 1*b* can be inverted and retained between two hooking structures 60*b* of the hooking unit 6*b* by matching the two top bending portions 410*b* and the hooking structures 60*b* on the ceiling. The heat-dissipating base 10*b* is hidden in the hooking unit 6*b*, and the lens 40*b* is exposed out of the hooking unit 6*b*. Hence, the light beams S generated by the light-emitting elements 21*b* pass through the lens 40*b* and generate upwards projecting light beams P3 with predetermined light-projecting angles so as to provide brightness the user's requirement. In addition, the present invention can generate different light-projecting angles due to the replacement of the lens 40*b*.

Figure 3:
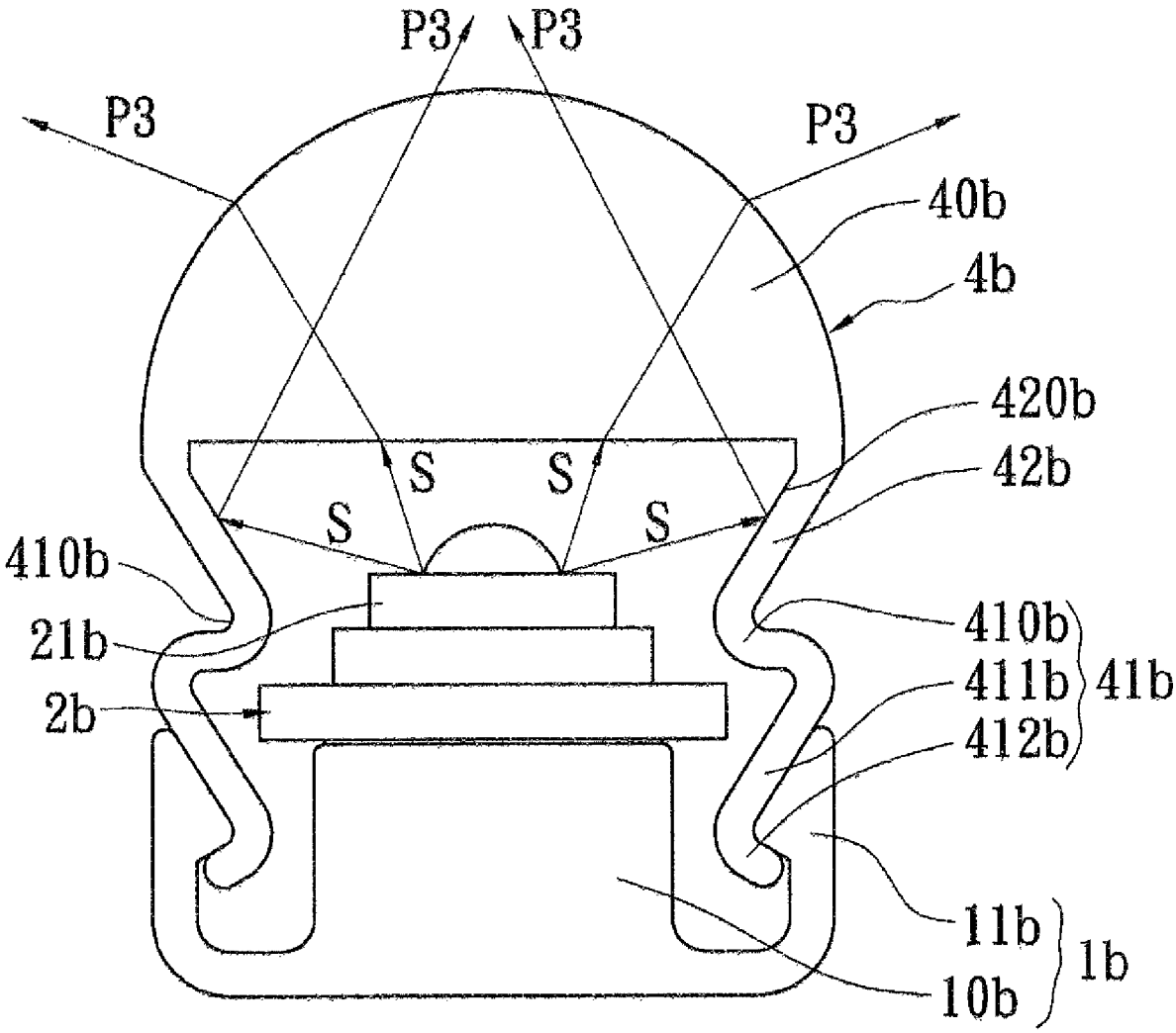
FIG. 3 is a lateral, schematic view of a custom assembly light-emitting module without the cover unit according to another embodiment of the present invention.

Referring to FIG. 3, the two reflected portions 42*b* and the two second retaining structures 41*b* are opaque substances, so that one part of light beams S generated by the light-emitting elements 21*b* are reflected by the two inclined surfaces 420*b* without using the reflective layers 421*b* as shown in FIG. 2C.

In conclusion, the base unit of the present invention is replaceable according to different heat-dissipating effects, the light-emitting unit of the present invention is replaceable according to different light-emitting effects, and the lens unit of the present invention is replaceable according to different light-projecting angles.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A custom assembly light-emitting module, comprising:

a base unit having a heat-dissipating base and two first retaining structures formed on two opposite lateral sides of the heat-dissipating base;

a light-emitting unit detachably disposed on the heat-dissipating base; and a lens unit having a lens, two reflected portions extending downwards from two opposite lateral sides of the lens and two second retaining structures respectively extending downwards from the two reflected portions, wherein the lens unit is detachably mated with the base unit by slidably engaging the two first retaining structures respectively with the two second retaining structures;

wherein each reflected portion has an inclined surface formed on an inner wall thereof, and the two inclined surfaces of the two reflected portions face each other and are disposed beside two opposite lateral sides of the light-emitting unit, so that one part of light beams generated by the light-emitting unit are reflected by the two inclined surfaces.

2. The custom assembly light-emitting module as claimed in claim 1, wherein the heat-dissipating base has a heat-dissipating body disposed on its bottom portion.

3. The custom assembly light-emitting module as claimed in claim 1, wherein the light-emitting unit has a substrate and a plurality of light-emitting elements electrically disposed on the substrate.

4. The custom assembly light-emitting module as claimed in claim 3, further comprising: a plurality of screw elements, wherein the substrate has a plurality of through holes corresponding to the screw elements, and one part of each screw element passes through the corresponding through hole so as to fix the substrate on the heat-dissipating base.

5. The custom assembly light-emitting module as claimed in claim 3, further comprising: a layer of heat-conducting glue or a heat-conducting piece disposed between the heat-dissipating base and the substrate.

6. The custom assembly light-emitting module as claimed in claim 1, wherein the two first retaining structures are two first sliding grooves facing each other, the two second retaining structures are two second sliding grooves in opposite direction to each other, and the two first sliding grooves and the two second sliding grooves are slidably matched with each other.

7. The custom assembly light-emitting module as claimed in claim 1, wherein each reflected portion is extended obliquely from the lens, and each second retaining structure has a top bending portion bent downwards from each reflected portion, an extending portion extended obliquely from the top bending portion, and a bottom bending portion bent downwards from the extending portion.

8. The custom assembly light-emitting module as claimed in claim 7, wherein each top bending portion has an S shape, and each bottom bending portion has an L shape.

9. The custom assembly light-emitting module as claimed in claim 7, wherein the lens unit is inverted and retained under a hooking unit by the two top bending portions mating with the hooking unit.

10. The custom assembly light-emitting module as claimed in claim 1, further comprising: two cover units respectively covering two opposite lateral sides of the base unit.

11. The custom assembly light-emitting module as claimed in claim 10, wherein each cover unit has a cover body and a protruding portion projecting from the cover body and fitted tightly between the two second retaining structures.

12. The custom assembly light-emitting module as claimed in claim 1, wherein each reflected portion has a reflective layer formed on each inclined surface.

13. The custom assembly light-emitting module as claimed in claim 1, wherein the two reflected portions and the two second retaining structures are light-transmitting substances.

14. The custom assembly light-emitting module as claimed in claim 1, wherein the two reflected portions and the two second retaining structures are opaque substances.

* * * * *